US006440191B1

(12) United States Patent
Berfield et al.

(10) Patent No.: US 6,440,191 B1
(45) Date of Patent: Aug. 27, 2002

(54) VACUUM CLEANER FILTER ASSEMBLY

(75) Inventors: Robert C. Berfield, Jersey Shore; Li H. Liu, South Williamsport, both of PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/594,542

(22) Filed: Jun. 14, 2000

(51) Int. Cl.[7] ..... B01D 27/14; B01D 29/58; A47L 9/12; A47L 9/18

(52) U.S. Cl. ..... 55/485; 55/486; 55/492; 55/510; 55/DIG. 3; 15/353

(58) Field of Search ..... 15/353; 55/482, 55/485, 486, 471, 467, 492, 510, DIG. 3

(56) References Cited

U.S. PATENT DOCUMENTS

| | | | | | |
|---|---|---|---|---|---|
| 3,488,928 | A | | 1/1970 | Tarala | 55/274 |
| 3,820,310 | A | | 6/1974 | Fromknecht et al. | 55/447 |
| 3,870,486 | A | | 3/1975 | Erikson et al. | 55/276 |
| 3,909,219 | A | | 9/1975 | Fromknecht | 55/216 |
| 4,297,114 | A | | 10/1981 | Hutchins | 55/299 |
| 4,304,580 | A | | 12/1981 | Gehl et al. | 55/482 |
| 4,609,387 | A | | 9/1986 | Berfield et al. | 55/320 |
| 4,623,366 | A | | 11/1986 | Berfield et al. | 55/216 |
| 4,801,376 | A | | 1/1989 | Kulitz | 210/123 |
| 4,894,881 | A | | 1/1990 | Palmer et al. | 15/328 |
| 4,906,265 | A | * | 3/1990 | Berfield | 55/379 |
| 5,032,155 | A | | 7/1991 | Wiese et al. | 55/216 |
| 5,205,014 | A | | 4/1993 | Yoo | 15/353 |
| 5,259,854 | A | | 11/1993 | Newman | 55/320 |
| 5,343,592 | A | | 9/1994 | Parise | 15/353 |
| 5,388,301 | A | | 2/1995 | Bosyj et al. | 15/327 |
| 5,394,587 | A | | 3/1995 | Parise | 15/353 |
| 5,455,983 | A | | 10/1995 | Crouser et al. | 15/331 |
| 5,608,945 | A | * | 3/1997 | Crouser et al. | 15/328 |
| 5,669,949 | A | | 9/1997 | Dudrey et al. | 55/486 |
| 5,733,351 | A | | 3/1998 | Hult et al. | 55/486 |
| 5,855,634 | A | | 1/1999 | Berfield | 55/472 |
| 5,871,567 | A | | 2/1999 | Covington et al. | 96/58 |
| 5,954,863 | A | | 9/1999 | Loveless et al. | 96/321 |
| 6,112,366 | A | * | 9/2000 | Berfield | 15/352 |
| 6,113,663 | A | * | 9/2000 | Liu | 55/459.1 |

* cited by examiner

*Primary Examiner*—Robert A. Hopkins
(74) *Attorney, Agent, or Firm*—Marshall Gerstein Borun

(57) ABSTRACT

A vacuum cleaner has a tank and a lid for closing off the tank. A motor/impeller unit is disposed inside the tank for generating an airstream. A filter support is attached to the lid and disposed inside the tank. A foam sleeve for removing liquid from the airstream is attached to the filter support. An air filter cartridge is removably attached to the filter support outside of the foam sleeve. The foam sleeve may remain in place as the filter cartridge is attached for dry pick-up or removed for wet pick-up. In addition, a drain hole is provided in the lid for draining liquid passing through the foam sleeve.

18 Claims, 5 Drawing Sheets

VACUUM CLEANER FILTER ASSEMBLY

FIELD OF THE INVENTION

The present invention relates generally to vacuum cleaners, and more particularly to filters for vacuum cleaners.

BACKGROUND ART

Wet/dry vacuum cleaners generally include a motor which drives an air impeller to create a low pressure area inside of a tank or other receptacle. The tank has an inlet through which dust and debris or liquid material enter into the tank, usually from a hose. The incoming airstream flows through the tank and exits out exhaust ports.

During dry pick-up, the dust or debris may pass into the air impeller, thereby interfering with operation of the air impeller or motor. In addition, the dust or debris may be exhausted back out into the room. To address the problems associated with the particulate-laden airstream, previous vacuum cleaners have typically included a filter for use during dry pick-up to collect the particulate material. Cylindrical or cartridge filters are often used which have large filtering surface areas and may be made of a variety of filtering materials. It has therefore been known to use a cylindrical filter with an open top and a closed bottom which is inserted over a filter cage. The top of the filter may be made of a flexible material such as rubber so that when the filter is pushed over the filter cage, the flexible material deforms and frictionally holds the filter in place. Other systems use cylindrical filters which are open at both ends. Such filters may fit over a filter cage having a closed bottom in order to prevent material from passing around the filter and into the air impeller. Other open-ended filters may use a retainer of some type which holds the filter in place and closes the open bottom end of the filter.

In addition, dual filter assemblies may be used which include two types of filter media concentrically arranged in a single filter unit, such as that disclosed in Newman, U.S. Pat. No. 5,259,854. High efficiency particle air ("HEPA") filters, which can remove 99.97% of particles larger than 0.3 microns from a stream of air, are useful for removing very small particles of dust or debris from air. Newman discloses a disposable filter cannister including an annular HEPA filter surrounded by a prefilter.

During wet pick-up, an air filter is not necessary and, in fact, may hamper vacuum cleaner performance. Once an air filter has been saturated with liquid, the amount of airflow through the filter is restricted, thereby reducing the capacity of the vacuum cleaner. With the filter in this condition, liquid may be sucked through the filter to collect inside the filter cage, and liquid entrained in the airstream may be pulled through the impeller and motor. As a result, liquid may be ejected out of the air exhaust ports of the vacuum cleaner. To obviate this problem, air filters are typically removed when switching from dry to wet pickup.

To reduce the amount of liquid entrained in the airstream during wet pickup, previous wet/dry vacuum cleaners have employed a foam cuff which is inserted onto the filter cage in place of the air filter. The filter cuff wicks liquid from the airstream and will typically generate a smaller pressure drop than that seen with the air filters. While the foam cuff performs adequately, a user of the wet/dry vacuum cleaner must remember to insert the foam cuff each time the air filter is removed. Replacement of the foam cuff is inconvenient and overly time consuming, and therefore a user may forget or choose not to install the foam cuff, thereby rendering the impeller and motor unprotected. In addition, the foam cuff may be lost or misplaced by the user.

An alternative filter arrangement is described in U.S. Pat. No. 4,906,265, wherein a foam cuff 30 fits over a filter cage 20 during wet operations.

When the vacuum cleaner is used on dry materials, a paper or cloth filter is placed over the foam cuff and attached with a retaining ring. The paper or cloth filter minimizes the amount of particulate material which escapes from the tank and passes to the air impeller. While this filter arrangement allows the foam cuff to remain in place during dry pick-up, the attachment of the cloth filter and retaining ring is cumbersome, and care must be taken so that the filter is properly centered over the foam cuff so that the entire filter cage is covered. As a result, a user may not take the time to insert the cloth filter and ring for dry pick-up, resulting in excess particulate matter passing through the air impeller and into the room.

SUMMARY OF THE INVENTION

In accordance with one aspect of the present invention, a filter assembly is provided for a vacuum cleaner having a filter support. The filter assembly comprises a liquid filter mounted on the filter support, and a first air filter removably attached to the filter support, the first air filter having a filter medium disposed about the liquid filter, the first filter defining a lower end. A cover is attached to the lower end of the first air filter.

In accordance with additional aspects of the present invention, a vacuum cleaner is provided comprising a tank, a lid removably attached to the tank, the lid carrying a filter support, and a foam sleeve mounted on the filter support. A first air filter is removably attached to the filter support, the first air filter having a filter medium disposed about the foam sleeve, the first filter defining a lower end. A cover is attached to the lower end of the first air filter.

In accordance with still further aspects of the present invention, a vacuum cleaner is provided comprising a tank, a lid removably attached to the tank, and a filter support carried by the lid. The filter support comprises a shroud depending from the lid defining a central recess and having a bottom wall, and a filter cage is supported inside the central recess. A drain hole is formed in the bottom wall, and a filter is removably attached to the bottom wall, the filter including an upper end cap. The upper end cap of the filter closes off the drain hole when the filter is attached to the shroud.

Other features and advantages are inherent in the vacuum cleaner claimed and disclosed or will become apparent to those skilled in the art from the following detailed description in conjunction with the accompanying drawings.

DETAILED DESCRIPTION OF THE EMBODIMENT

Figure 1:
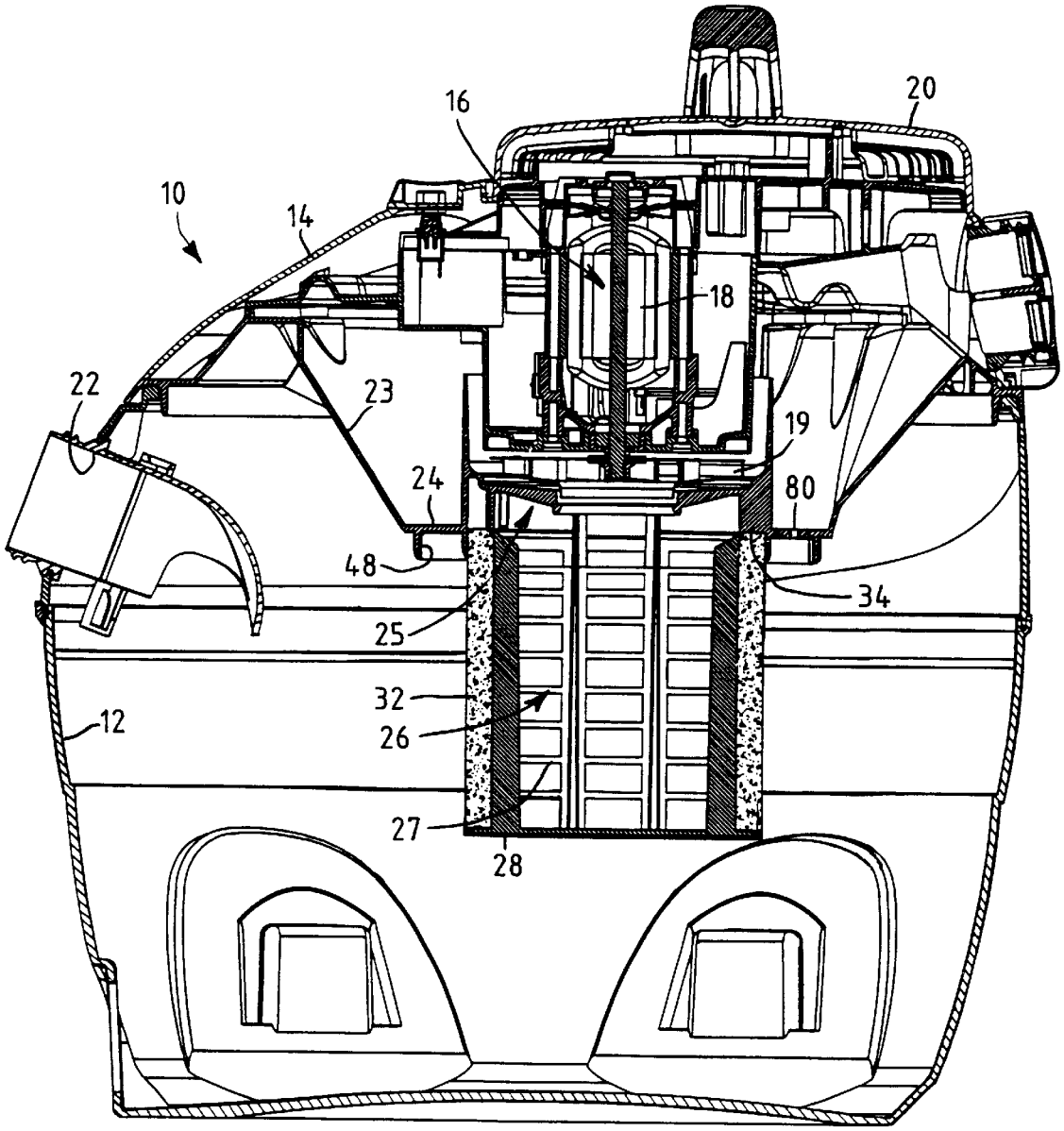
FIG. 1 is a side elevation view, in cross-section, of one embodiment of a filter assembly in accordance with the teachings of the present invention incorporated into a vacuum cleaner adapted for wet pick-up.

Referring initially to FIG. 1, a vacuum cleaner 10, which can be a wet/dry vacuum cleaner, includes a tank 12 onto which a lid 14 is attached. A motor/impeller unit 16 having a motor 18 and an impeller 19 is attached to the lid 14. The lid 14 includes an inlet 22 through which air is drawn by the motor/impeller unit 16. Typically, a housing 20 covers the motor/impeller unit 16.

An inner shroud 23 depends from a bottom surface of the lid 14. The inner shroud 23 defines a bottom wall 24 and a central recess 25. A filter support, such as a filter cage 26, is attached to the central recess 25 of the inner shroud 23. In the embodiment illustrated at FIG. 1, the filter cage 26 has side ribs 27 and a bottom plate 28. The bottom plate 28 closes off the bottom of the filter cage 26. The side ribs 27 define an outer periphery of the filter cage 26 having a generally cylindrical shape.

As illustrated in FIG. 1, a foam sleeve 32 is inserted over the outer periphery of the filter cage 26 for removing liquid entrained in the airstream during wet pick-up. The foam sleeve 32 has a generally cylindrical inner diameter sized for insertion over the filter cage 26. A top lip 34 formed in the filter cage 26 engages an upper end of the foam sleeve 32, while an outer edge of the bottom plate 28 engages a lower end of the foam sleeve to secure the sleeve in place. The foam sleeve 32 is preferably removable so that the foam sleeve 32 may be replaced, if necessary.

Figure 2:
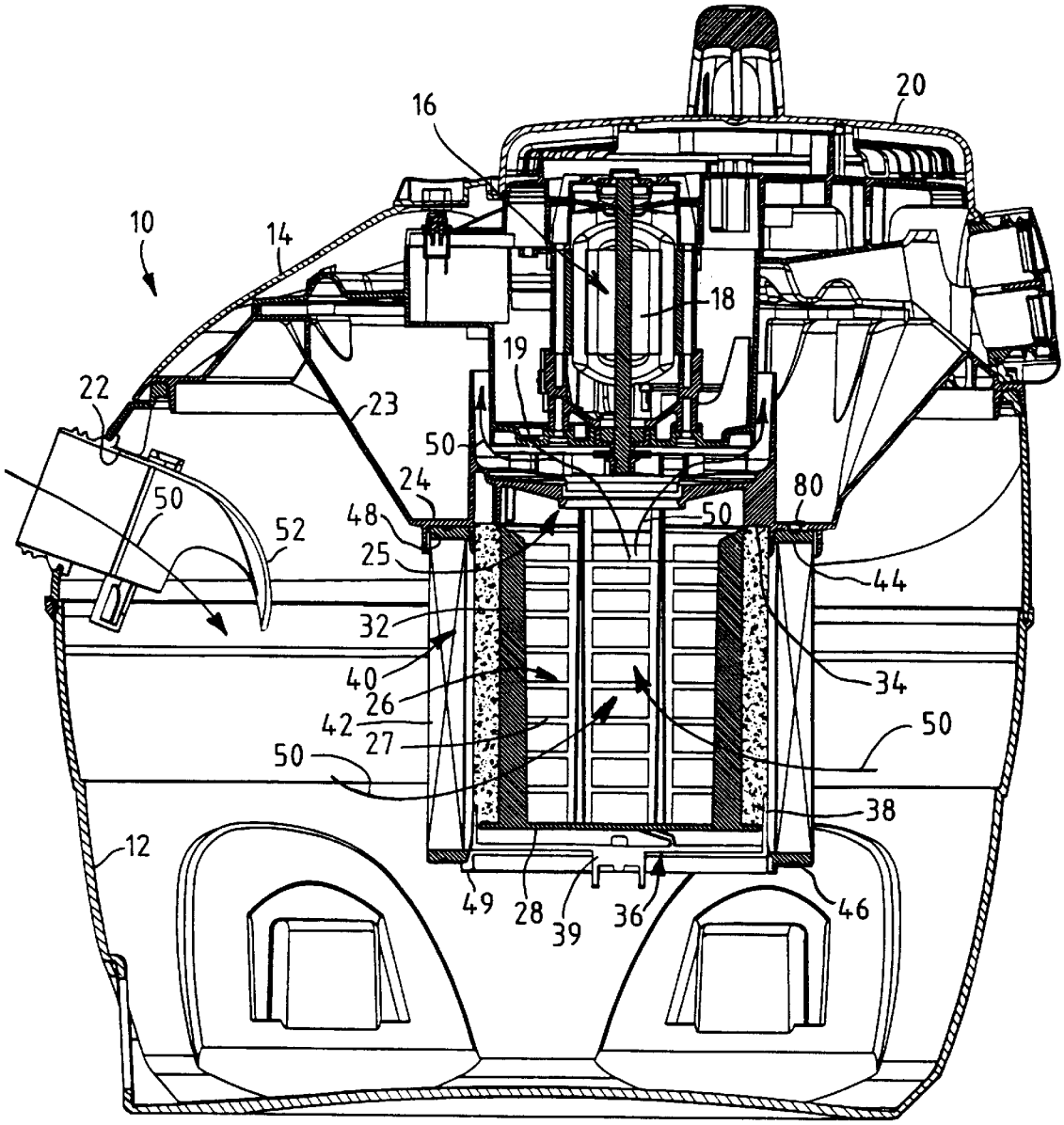
FIG. 2 is a side elevation view, in cross-section, of the vacuum cleaner of FIG. 1 having a filter cartridge for dry pick-up.

A filter cartridge 40 is provided, during dry pick-up for removing particulate matter from the airstream. As shown in FIG. 2, the filter cartridge 40 includes a generally cylindrical filter medium 42 sized to extend around the foam sleeve 32 and having upper and lower end caps 44, 46. The filter element 42 is positioned so that the upper end cap 44 engages a channel 48 formed in the bottom wall 24 of the inner shroud 23. The upper end cap 44 is preferably made of a resilient material and sized to grippingly engage the channel 48, thereby frictionally holding the filter cartridge 40 in place and forming a seal therebetween.

A cover 36 is attached to the foam sleeve 32 for closing off the lower end cap 46 of the filter cartridge 40. The cover 36 has a cylindrical wall 38 with an inner diameter sized to engage the foam sleeve 32, so that the cover 36 is frictionally held in place. The cover 36 further includes a grip 39 which allows the user to easily grasp the cover 36 during attachment and removal. An outer flange of the cover 36 is sized to engage an inner edge of the lower end cap 46. The outer flange 49 not only seals with the lower end cap 46, but also provides further frictional engagement with the lower end cap 46 to help hold the cover 36 in place. The cover 36 is described in more detail in U.S. patent application Ser. No. 08/881,423, now U.S. Pat. No. 5,855,634, and U.S. patent application Ser. No. 09/143,980, now U.S. Pat. No. 6,110,248, the disclosures of which are hereby incorporated by reference.

The upper and lower end caps 44, 46 may be formed during assembly of the filter cartridge 40 by molding a polyvinyl chloride ("PVC") type plastisol onto the filter medium 42. Plastisol is commonly used as a potting material for filters, and forms an elastomeric material after curing. Other types of plastisols, such as epoxy or polyurethane types, which require two-part mixtures that cure after mixing, may also be used.

The flow of air through the vacuum cleaner 10 during ordinary operation is illustrated by arrows 50 in FIG. 2. Air is drawn into the tank 12 through the air inlet 22 by action of the motor/impeller unit 16. A deflector shield 52 deflects the flow of incoming air, and the air then flows through the filter medium 42. The air next flows through the foam sleeve 32, and is drawn up and through exhaust ports (not shown) formed in the lid 14.

When the vacuum cleaner 10 is used for dry pick-up, the filter cartridge 40 is inserted over the filter cage and foam sleeve 32 until the upper end cap 44 is frictionally held by the channel 48. The cover 36 is then attached to the bottom of the filter cartridge 40 so that the outer flange 49 and cylindrical wall 38 of the cover 36 engage the lower end cap 46 and foam sleeve 32, respectively. With the filter cartridge 40 in position, the filter medium 42 removes particulate matter from the airstream. To convert the vacuum cleaner 10 back to wet pick-up, the cover 36 and filter cartridge 40 are removed.

Figure 3:
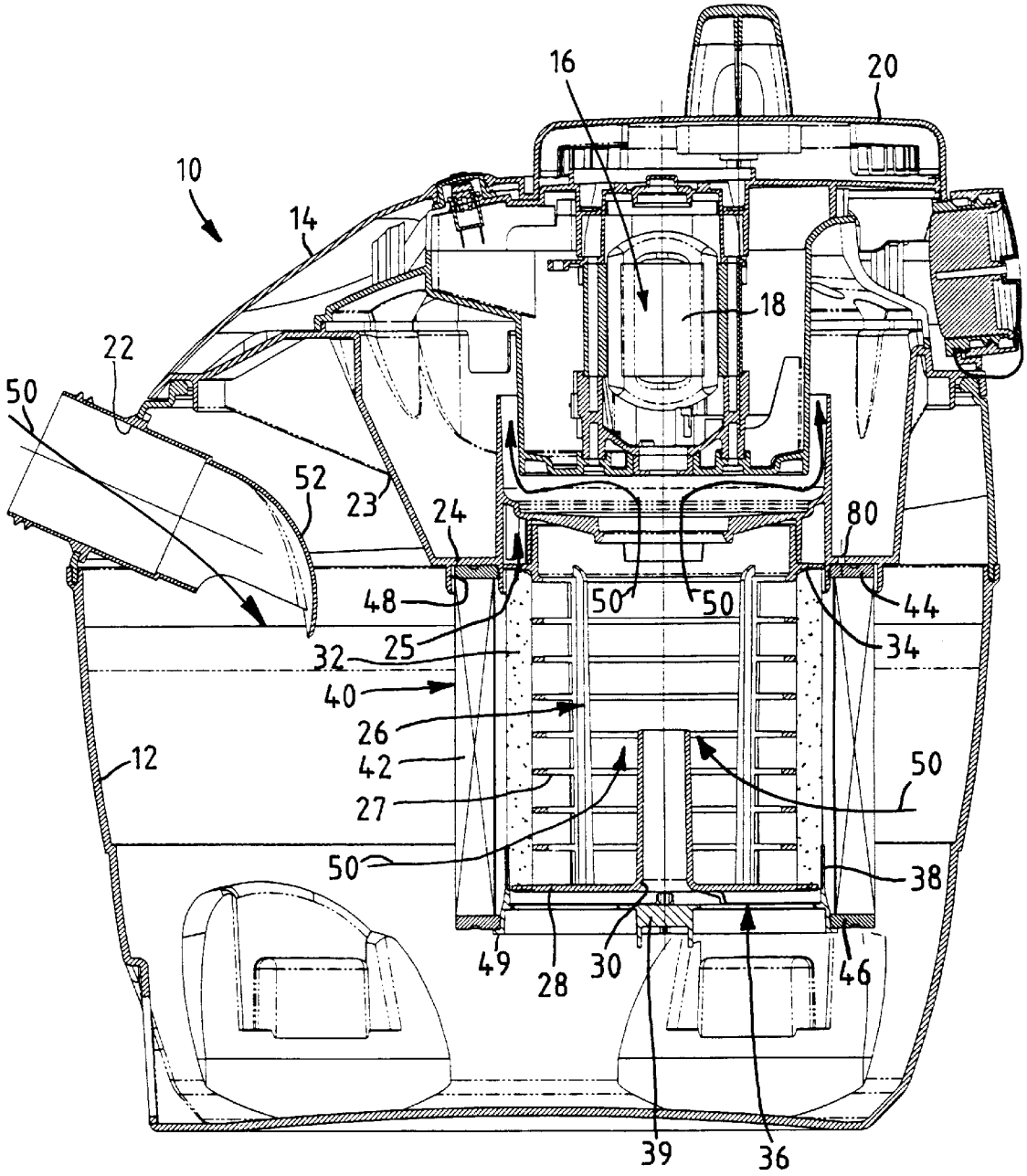
FIG. 3 is a side elevation view, in cross-section, of an alternative vacuum cleaner adapted for self-evacuation, the alternative vacuum cleaner including a filter cartridge for dry pick-up.

While the vacuum cleaner 10 described to this point is a standard wet/dry vacuum, it will be appreciated that the present invention may be used in other types of vacuum cleaners in accordance with the present invention. For example, the vacuum cleaner 10 may include a pump for self-evacuating the tank 12. In such an embodiment, the bottom plate 28 of the filter cage 26 includes an opening 30 (FIG. 3) for receiving pump inlet piping (not shown). Accordingly, the cover 36 must be replaced over the foam sleeve 32 to close off the opening 30 during standard wet pick-up. If pumping is to take place during wet pick-up, the cover 36 is left off and the pump inlet piping is inserted through the opening 30 for attachment to a pump (not shown). In each of the above situations, the foam sleeve 32 need not be removed from the filter cage 26.

Figure 4:
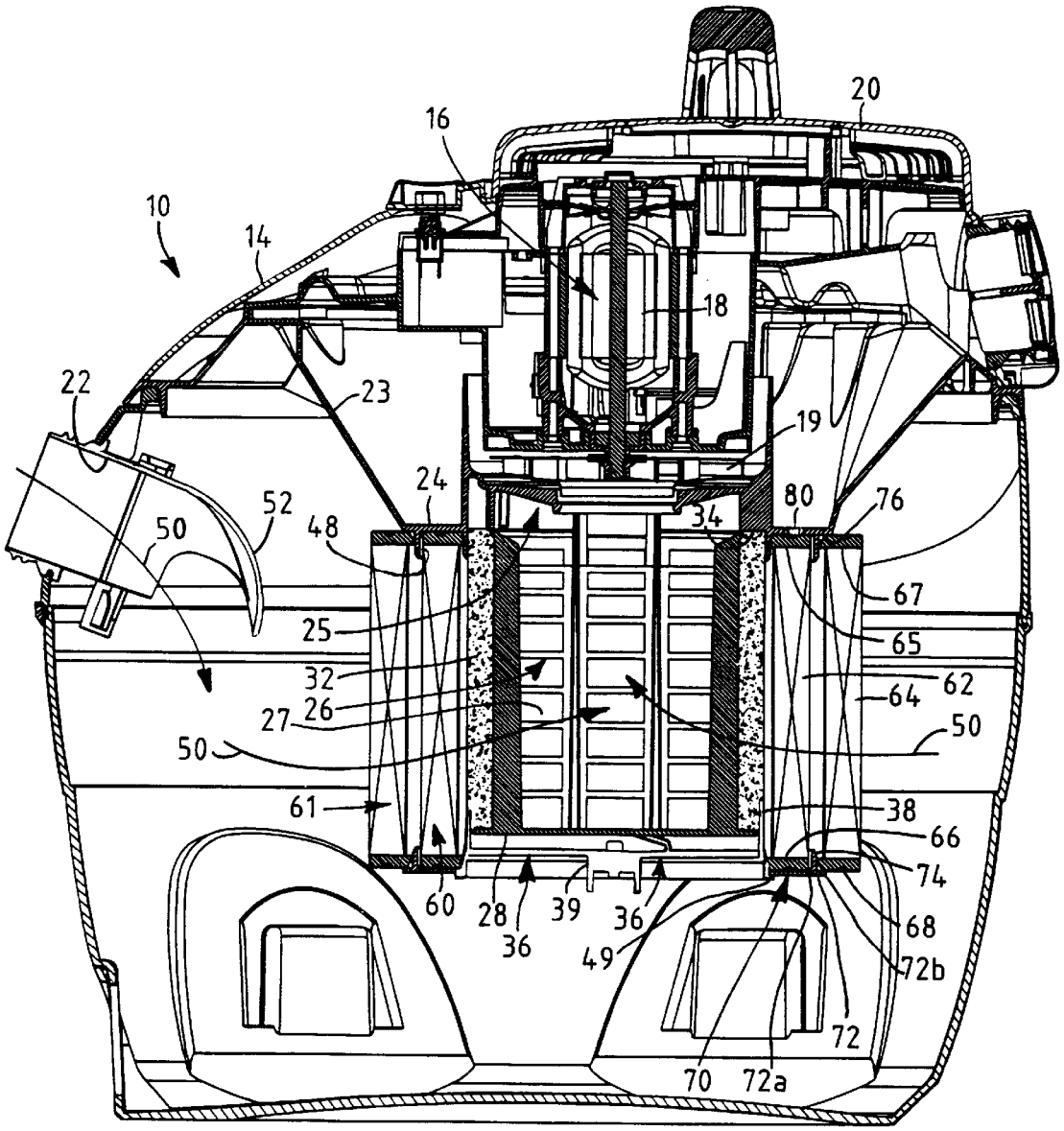
FIG. 4 is a side elevation view, in cross-section, of the filter cartridge of FIG. 1 having an alternative filter assembly.

In a further alternative embodiment illustrated at FIG. 4, inner and outer filter elements 60, 61 are positioned about the filter cage 26 for improved air filtering. The inner filter element 60 has a generally cylindrical filter medium 62 disposed about the foam sleeve 32, and includes integral upper and lower end caps 65, 66. The outer filter element 61 has a cylindrical filter medium 64 extending about and concentric with the inner filter medium 62. The outer filter medium 64 also has upper and lower end caps 67, 68.

An extension ring 70 is provided for securing the lower end caps 66, 68 of the inner and outer filter elements 60, 61. According to FIG. 4, the extension ring 70 comprises a generally annular flange 72 and an intermediate cylindrical wall 74. The cylindrical wall 74 divides the annular flange 72 into inner and outer flange portions 72*a*, 72*b*. The inner flange portion 72*a* is sized to receive the lower end cap 66 of the inner filter element 60. The outer flange portion 72*b* engages an inner edge of the bottom end cap 68 of the outer filter element 61.

As with the previous embodiment, the bottom wall 24 of the inner shroud 23 includes the channel 48 for receiving the upper end cap 65 of the inner filter element 60. The bottom wall 24 also extends past the channel 48 to provide a lip 76 for frictionally receiving an inner edge of the upper end cap 67 of the outer filter element 61.

To assemble the filter arrangement, the inner filter element 60 is inserted into the channel 48 and the outer filter element 61 is inserted onto the lip 76 so that the inner and outer filters 60, 61 are frictionally supported by the inner shroud 23. Next the extension ring 70 is inserted over the cylindrical wall 38 of the cover 36 until the ring 70 rests on the outer flange 49. The combined cover 36/extension ring 70 is attached to the lower end caps 66, 68 and foam filter 32, so that the cover 36 closes off the opening 30 and the extension ring 70 seals with the lower end caps 66, 68.

In the foregoing embodiments, the filter media are typically formed in a pleated configuration, and may be made from paper, non-woven polyester, or non-woven polypropylene. If non-woven polyester is used, it may comprise melt-blown or spun-bonded polyester, or a combination of melt-blown and spun-bonded polyester. Likewise, if non-woven polypropylene is used, it may comprise melt-blown or spun-bonded polypropylene, or a combination of melt-blown and spun-bonded polypropylene. Preferably, the inner medium 64 comprises a HEPA filter medium.

Figure 5:
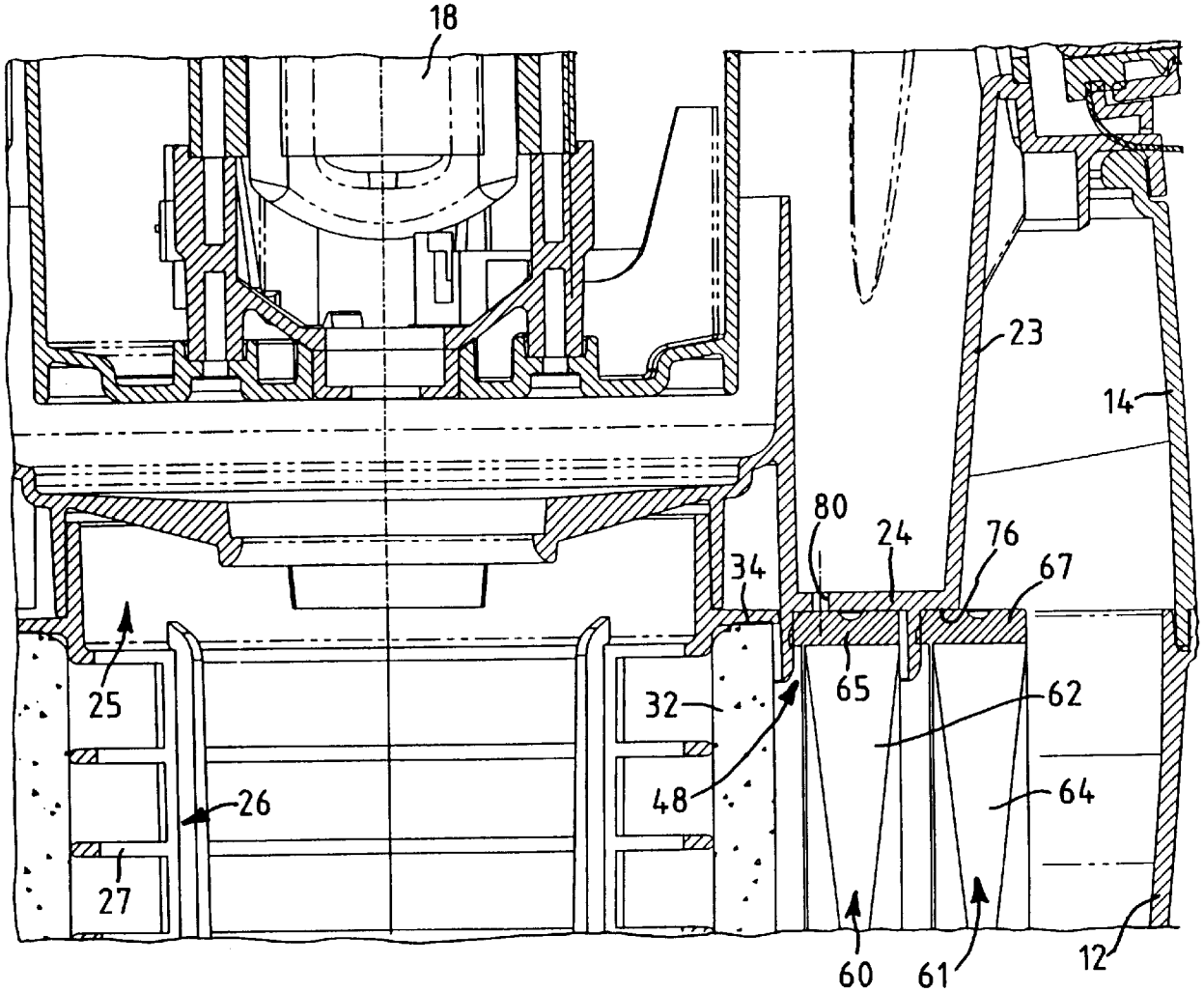
FIG. 5 is an enlarged side elevation view, in cross-section, of a portion of the filter assembly of FIG. 4.

In accordance with additional aspects of the present invention, a drain hole 80 is formed in the bottom wall 24 of the inner shroud 23 for draining liquid pulled into the shroud 23 during wet pick-up. As best shown in FIG. 5, the drain hole 80 is formed in the bottom wall 24 through a base of the channel 48. Accordingly, when a filter is installed into the channel 48 for dry pick-up, an upper end cap of the filter covers the drain hole 80 to prevent suction loss through the drain hole 80. During wet pick-up, when the filter is removed, the drain hole 80 is exposed. Liquid pulled through the foam sleeve 32 tends to collect on the inner surface of the shroud 23 to form droplets. The liquid droplets fall to the bottom wall 24 of the shroud 23. The drain hole 80 allows liquid collecting at the bottom wall 24 to drain back into the tank 12, thereby reducing the risk of discharging water out the exhaust ports. While the exposed drain hole 80 may also provide a path for unfiltered air to enter the motor/impeller unit 16 during wet pick-up, most particulate matter collected during wet pick-up is entrained in the liquid, and therefore the risks normally posed by unfiltered air are reduced.

The foregoing detailed description has been given for clearness of understanding only, and no unnecessary limitations should be understood therefrom, as modifications will be obvious to those in the art.

What is claimed is:

1. A filter assembly for a vacuum cleaner having a filter support and operable in a dry vacuum mode, for collecting dry materials, and a wet vacuum mode, for collecting liquid material, the filter assembly comprising:

a liquid filter mounted on the filter support during both dry and wet vacuum modes;

a first air filter removably attached to the filter support during the dry vacuum mode, the first air filter having a filter medium disposed about the liquid filter, the first filter defining a lower end; and a cover attached to the lower end of the first air filter wherein the first air filter is removed during the wet vacuum mode.

2. The filter assembly of claim 1, in which the liquid filter comprises a foam sleeve.

3. The filter assembly of claim 1, in which the vacuum cleaner comprises a tank with a removable lid, and the filter support comprises a shroud depending from the lid and a filter cage, in which the liquid filter is adapted for attachment to the filter cage and the first air filter is adapted for attachment to the shroud.

4. The filter assembly of claim 3, in which the shroud defines a channel, and in which the first air filter comprises an upper end cap sized for insertion into the channel.

5. The filter assembly of claim 1, further comprising a second air filter removably attached to the filter support during the dry vacuum mode and positioned concentric with the first air filter, the second air filter having a filter medium disposed about the first air filter and defining a lower end for engaging the cover, wherein the second air filter is also removed during the wet vacuum mode.

6. The filter assembly of claim 5, in which the cover comprises a ring extension having a flange portion engaging the first and second air filters.

7. The filter assembly of claim 6, in which the ring extension is separable from the cover.

8. The filter assembly of claim 5, in which the vacuum cleaner comprises a tank with a removable lid, and the filter support comprises a shroud depending from the lid and a filter cage, in which the liquid filter is adapted for attachment to the filter cage and the first and second air filters are adapted for attachment to the shroud.

9. The filter assembly of claim 8, in which the shroud defines a channel and a lip, and in which the first air filter comprises an upper end cap sized for insertion into the channel and the second air filter comprises an upper end cap sized for insertion over the lip.

10. A vacuum cleaner comprising:

a tank;

a lid removably attached to the tank, the lid carrying a filter support;

a foam sleeve mounted on the filter support;

a first air filter removably attached to the filter support, the first air filter having a filter medium disposed about the foam sleeve, the first filter defining a lower end; and a cover attached to the lower end of the first air filter.

11. The vacuum cleaner of claim 10, in which the filter support comprises a shroud depending from the lid and a filter cage attached to the shroud, wherein the foam sleeve is attached to the filter cage and the first air filter is attached to the shroud.

12. The vacuum cleaner of claim 11, in which the shroud defines a channel, and in which the first air filter-comprises an upper end cap sized for insertion into the channel.

13. The vacuum cleaner of claim 10, further comprising a second air filter removably attached to the filter support and positioned concentric with the first air filter, the second air filter having a filter medium disposed about the first air filter and defining a lower end for engaging the cover.

14. The vacuum cleaner of claim 13, in which the cover comprises a ring extension having a flange portion engaging the first and second air filters.

15. The vacuum cleaner of claim 14, in which the filter support comprises a shroud depending from the lid and a filter cage attached to the shroud, wherein the foam sleeve is attached to the filter cage and the first and second air filters are attached to the shroud.

16. The vacuum cleaner of claim 15, in which the shroud defines a channel and a lip, and in which the first air filter comprises an upper end cap sized for insertion into the channel and the second air filter comprises an upper end cap sized for insertion over the lip.

17. A vacuum cleaner comprising:

a tank;

a lid removably attached to the tank;

a filter support carried by the lid, the filter support comprising a shroud depending from the lid defining a central recess and having a bottom wall, and a filter cage supported inside the central recess;

a drain hole formed in the bottom wall;

a liquid filter mounted on the filter cage; and an air filter removably attached to the bottom wall, the air filter including an upper end cap;

wherein the upper end cap of the air filter closes off the drain hole when the filter is attached to the shroud.

18. The vacuum cleaner of claim 17, in which the shroud further defines a channel for receiving the air filter upper end cap, and in which the drain hole is formed in a base of the channel.

* * * * *